United States Patent [19]

Yang

[11] Patent Number: 4,971,301

[45] Date of Patent: Nov. 20, 1990

[54] VISE

[76] Inventor: Tai-Her Yang, 5-1 Taipin St., Si-Hu Town, Dzan-Hwa, Taiwan

[21] Appl. No.: 133,653

[22] Filed: Dec. 16, 1987

[51] Int. Cl.[5] ..... B25B 1/10

[52] U.S. Cl. ..... 261/153; 269/247; 269/287

[58] Field of Search ..... 269/152–155, 269/43, 246, 247, 906, 287; 24/525, 486

[56] References Cited

U.S. PATENT DOCUMENTS

| | | | |
|---|---|---|---|
| 851,491 | 4/1907 | Broodbooks | 269/246 |
| 1,012,226 | 12/1911 | Starrett | 269/247 |
| 2,139,292 | 12/1938 | Tramsak | 269/247 |
| 3,861,664 | 1/1975 | Durkee | 269/153 |
| 4,040,613 | 8/1977 | Kartasuk et al. | 269/247 |
| 4,066,250 | 1/1978 | Campbell | 269/153 |
| 4,241,906 | 12/1980 | Cole | 269/153 |
| 4,341,375 | 7/1982 | Romanin | 269/153 |
| 4,529,183 | 7/1985 | Krasm et al. | 269/247 |

FOREIGN PATENT DOCUMENTS

| | | | |
|---|---|---|---|
| 3209984 | 5/1983 | Fed. Rep. of Germany | 269/43 |
| 210210 | 11/1924 | United Kingdom | 269/247 |

*Primary Examiner*—Robert C. Watson
*Attorney, Agent, or Firm*—Leonard Bloom

[57] ABSTRACT

A vise having a fixed jaw on a body which has a base secured to a work surface and may be rotated through 180°. The body has a guide slot formed therein and a movable jaw is slidably received in the guide slot. A guide rod is disposed through an opening in the movable jaw and is threadably received in an upright lug secured to the base for movement of the movable jaw. A positioning nut is keyed to the threaded guide rod and secures the movable jaw to the guide rod. The vise has clamp claws on the inner and outer sides of the fixed and movable jaws so that the vise can exert force in both directions. The workpiece may be clamped between the inner side of the jaws and the jaws may be adjustably disposed within the workpiece to secure the workpiece about the outer side of the jaws. The end of the movable jaw which extends through the body has a notched slot therein and there is also a notched recess in the body of the vise. A workpiece may be disposed vertically in the notched slot and clamped against the notched recess in the body.

4 Claims, 11 Drawing Sheets

FIG. 4-7
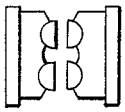
FIG. 4-6
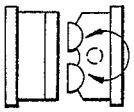
FIG. 4-5
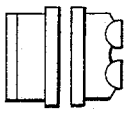
FIG. 4-4
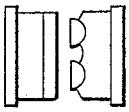
FIG. 4-3
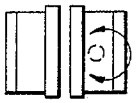
FIG. 4-8
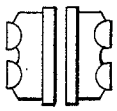
FIG. 4-9
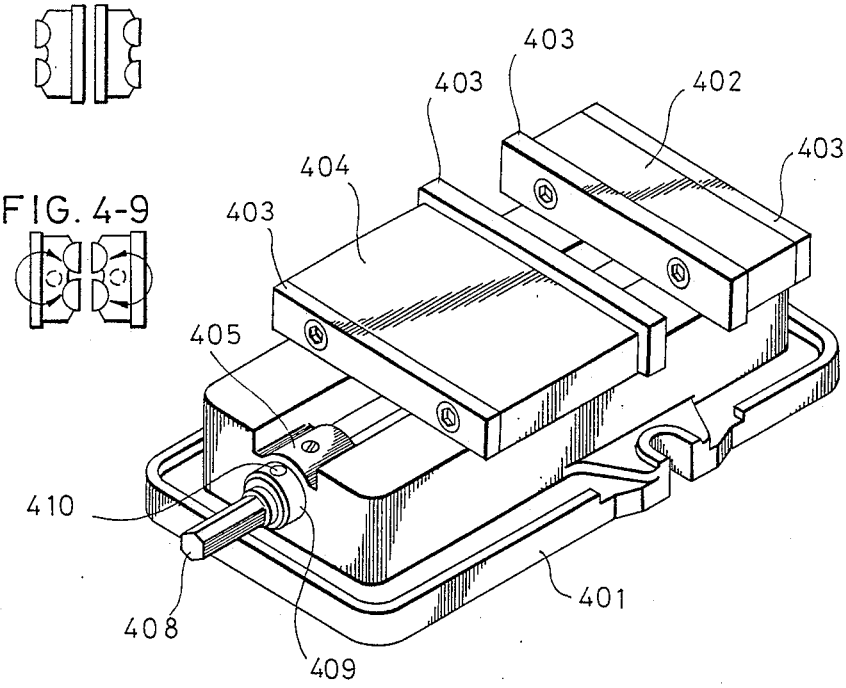
FIG. 4

VISE

BACKGROUND AND SUMMARY OF THE INVENTION

The conventional parallel clamp-type vise is to clamp and hold a clamp or press a work piece with a strong force for forming, or for pressing and changing its outer configuration. Therefore, its structural feature lies in that the movable jaws and fixed jaws have sturdy machine body structure, and the opposite inner sides of its two jaws have parallel clamp claw sets, meanwhile, the join relationship of its drive guide rods and guide screws with various jaws preconditioned on that it can unidirectionally bear the applied strong force along the clamping and fixing direction. However, except that some work pieces are clamped and held, some others are of a hollow frame form as shown in Enclosure 1 or a concave slots as shown in Enclosure 2, and if and when this kind of work pieces need to be processed on their outer sides, the above-said clamping and holding way is no longer applicable. To provide a reasonable clamping and holding to this kind of work pieces, this design provides a kind of two clamp jaws, the two (front and rear) sides of which are provided with the clamp claw sets respectively; a guide rod having a structure which can apply forces in two directions; and the movable jaws having a structure to receive the strong drive in two directions by the manually operated or the electric motor driven guide rod or the oil hydraulic or pneumatic powered elements, thereby providing the above-said work pieces with the clamp vise improvements to clamp and hold the work pieces by its functions to stretch outwardly to clamp and hold the work pieces and also to maintain its original clmaping and holding functions. Besides, when it is used as a table vise, its arrangement has its movable jaws with two-directional traction forces and its screw structure, so the upper and lower rims of the innner guide holes in its fixed jaws can be further made with innner concave terraced tooth form, and the tooth-shaped holes are provides in the end and the tooth-shaped holes are provided in the end and along the perpendicular direction of the guide machine body of the movable jaws to mutually use the opposite drives to clamp and hold the perpendicular work pieces.

This design makes the outer sides of the two clamp jaws of the conventional vise into the clamp planes with clamp claws, and its drive the clamp planes with clamp claws, and its drive guide rod and nut are made into the vise with new functions to be subjected to the forces in two directions to accept the drive by the manually operated, or electric motor operated or oil hydraulic or pneumatic-powered elements, so the vise can clamp and hold a work piece in two directions and also can push outward to clamp and fix a work piece or can stretch outward to form a work piece, or can tract the inner concave teeth on the upper and lower rims of the inner guide holes in the fixed jaws of the body of the table vise and the tooth holes in the end of the guide machine body of the movable jaws of the body of table vise to vertically clamp a work piece.

As known to all, the conventional vises comprise a strong work bench-type vise or drill vise or precision milling machine vise, with a basic structure as follows: i.e. on the inner sides of the parallel clamp jaw, the clamp claws are provided to receive the the mutually closing or moving away drive for mutually clamping or releasing a work piece. The vises made according to the above-said structural principle are widely known to the people and also used by them.

However, under various processing conditions, it is unreasonable to say that a work piece onlyneeds the opposite clamping and fixing principle of design. Since some work pieces are in hollow frame forms or inner concave slots, but when their outside profiles are ready to receive the processing, the above-said vises are unfit to clamp and fix them, but a clamp vise that can push and stretch outward is badly needed.

The improvements on vise in the present invention is designed responsive to the above requirements, mainly the outer sides of the movable jaws and fixed jaws of the vise are further provided with clamp claws, and the traction struction between the drive structure and the movable jaws is designed as structure to use strong tractions in two directions; on the body of the clamp vise, the support posts to support the drive elements and the drive elements have the join structure respectively to receive the forces in the two directions, thereby providing the strong clamping or streching or pushing actions. The following design of the present inventon is applied to the examplary forms (A) table vise, (B) drill vise, (C) milling machine vise, under the common innovative disclosure, they have the above-said applicatory structural forms as described above:

BRIEF DESCRIPTION OF THE DRAWINGS

FIG. 1—1 is a top view of FIG. 1.

FIG. 1—2 is a top side view of FIG. 1.

FIG. 1—3 to 1—9 are various examplary forms of the clamp claw shown in FIG. 1.

FIG. 2 table vise in a design of the rear side mounted movable jaw in respect to the application of the structure having the two-directional clamping functions.

FIG. 2-1 is a side view of FIG. 2.

FIG. 2—2 is a top view of FIG. 2.

FIGS. 2-3 to 2-9 show the examplary forms of various clmap claws shown in FIG. 2.

FIG. 3 shows an examplary form of the drill vise in respect to the application of the two-directional clamping functions.

FIG. 3-1 is a top view of FIG. 3.

FIG. 3-2 is a side view of FIG. 3.

FIG. 3—3 is a cross sectional view of the front view part of FIG. 3,

FIGS. 3-4 to 3-10 show examplary forms of various clamp claws shown in FIG. 3.

FIG. 4 is an examplary view of the precision milling machine vise.

FIG. 4-1 is a top view of FIG. 4.

FIG. 4-2 is a side view of FIG. 4.

FIG. 4-3 to 4-9 show the examplary forms of various clmap claws shown in FIG. 4.

FIGS. 5 to 5—5 show an exemplary form of the clamping vise driven by an electric motor.

FIGS. 5—5 to 5-7 show exemplary forms of clamping forces.

DETAILED DESCRIPTION OF THE PREFERRED EMBODIMENTS

Figure 1:
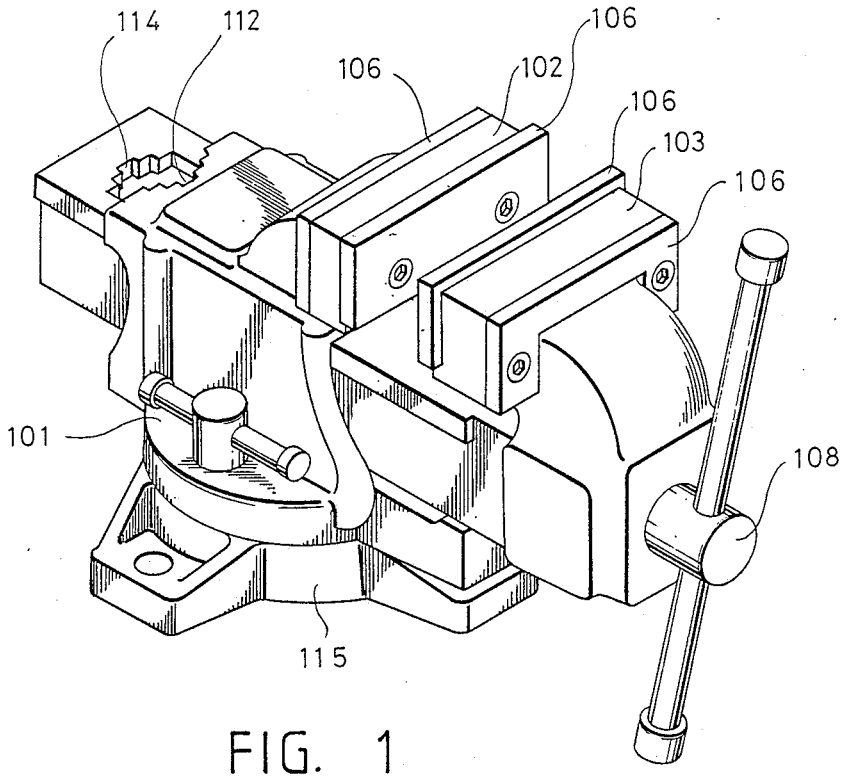
FIG. 1 is an perspective view of the table vise having the two-directional clamping function.
Figures 1, 2, 3:
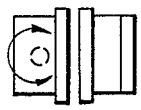

(1) As shown in FIGS. 1, 1—1, 1-2, an examplary form of the table vise having the two-directional clamping functions is illustrated, which mainly comprises:

a body 101 having the fixed jaw 102 which has a twodirectional clamp claw, the body 101 also having a longitudinal guide hole (or slot) to receive the machine body of the movable jaw 103, a bottom (or cover) base provided under the body member for fixing on the work bench or joining a bottom to make angular adjustments, a concave slot 104 in the inner part of the body member to receive the shaft (or upstanding bug) 105;

a movable jaw 103 with clamp claws 106 on its two sides, its elongated strip-type machine body in a form to couple the longitudinal hole in the machine body in order to receive the drive of the guide rod 107 to reciprocatingly slide therebetween, a round hole 108 is journaled in the front end of the machine body to receive the guide rod 107, a drive guide rod 107 passing through the rear hole 108 in the front end of the machine body of the movable jaw, its passing-through section having a thread 109 to receive a positioning nut 110, a through hole ( or key) between the positioning nut 110 and guide rod respectively to receive the positioning cotter pin 111;

a set of shaft 105 having inner screw holes to receive the longitudinal concave slot 104 of the body.

From the above-said vise structure, we can use the positive and reverse rotations of the guide rod 107 to dirve the movable jaws 103 which in turn will clamp the work piece or push or stretch to clamp the work piece.

Under the foundation of the above-said design, We may use the following-listed clamp claw sets to form various wide applications, for instance, as shown in FIG. 1–3, the rotary clamp claw used and disclosed in the U.S. Pat. No. 2,881,645, so we can make one of its clamp claw have a rotary shaft to be applicable to the innner frames or slots, parallel or non-parallel.

As shown in FIG. 1–4, the U.S. Pat. No. 4,632,374 is used, of which a set of clamp claws have two slidable clamp claws, so we can use the clamp claw set having function to clamp irregular work pieces and to push and stretch outward;

FIG. 1–5 is a slidable clamp claw shown in FIG. 1–4 and provided on the outer side of one of the jaw sets, while the outer side of the other clmap jaw is a flat clamp claw and the inner sides of two jaws are also of the flat clamp claw to stretch and push the irregular work pieces; shown in FIG. 1–6 is the rotary jaw having the slidable clamp claw and flat clamp claw as shown in FIG. 1–4 to clamp a work piece inward or push and stretch a work piece outward.

FIG. 1–7 is an examplary form of two sets of jaws with the slidable clamp claws disclosed in the U.S. Pat. No. 4,632,374 on their inner sides respectively and their outer sides have the outstreching flat clamp claws.

FIG. 1–8 is an examplary form of two sets of jaws with the slidable clamp claws disclosed in the U.S. Pat. No. 4,632,374 and their inner sides with parallel clamp claws to push and stretch the irregular work pieces.

FIG. 1–9 is an examplary form of two sets of rotary jaws with two slidable clamp claws on their one side and their other side with flat clamp claws.

Since the designed drive screw and movable jaws of the present invention can subject to the forces applied in two directions, said table vise can further use the inner concave tooth terrace ( or notch) shapes 112 provided on the upper and lower rims in the inner side (not on the handle bar side of the guide rod) of the body and the elongated slot hole 113 in the upper side of the end section of the elongated strip-type machine body of the movable jaw, the upper side close to the end of the elongated slot hole 113 is also in a concave tooth-type terrace (or notch) shape 114, when the screw 103 is driven in a reverse direction, the concave tooth terrace shapes 112 formed in the upper and lower rims in the inner side of the said body and the concave tooth terrace shape 114 in the end side of the elongated slot holes in the end of the elongated strip-type machine body of the movable jaw constitute the function to clamp the longer upright work pieces (especially the upright pipes and rods), when said vise is provided with a rotary seat 115 which is locked on its work side, the vise can be rotated 180°, so the above-said perpendicularly clamped work piece can be extended to the floor, and therefore this is particularly applicable to the maintenance and processing for such kinds of pipes rods and strips.

Besides, since the table vise also has a design of the backwardly installed movable jaws as shown in FIGS. 2, 2–1,2–3, in such a design, similarly clamp claws 2–3 are provided on the two sides of the movable jaws 202 and fixed jaws 201 respectively, because the movable jaws 202 themselves have screw holes to couple the guide screw 204, their pushing and stretching force-application structure characterizes that threads 205 and transverse through hole 206 are provided in the inner side to couple the guide rod 204 and the fixed body, and the positioning nut 208 joined to and sleeved on the positioning pin 207 is to beef up its strength to stand the forces thus applied thereon, as shown in FIGS. 2–3 to 2–9 are various examplary forms of the same clamp claws shown in FIGS. 1–3 to 1–9.

(2) As shown in FIGS. 3, 3–1, 3–2, 3—3, the invention is used to the drill vise, which mainly comprises:

a machine base 301, one of its end having a fixed jaw 302, two sides of said jaw 302 having flat clamp claws 303 respectively, its middle section having a guide rail 304 and a guide slot 305 to allow the movable jaw 306 sliding therebetween, its other side having a pair of support posts 307 with a spiral hole therein respectively to receive the guide rod 308;

a movable jaw 306 having parallel flat clamp jaws 303, its bottom having a longitudinal protrusion 309 to couple the guide rail 305 of the machine base and also having a latitudinal cutout 310 to receive a slidable annular block 311, its side that facing the support posts 307 having a longitudinal through hole to receive the screw 308, and screw holes on its bottom to firmly lock the base 212;

a guide screw 308 having a handle bar 313 and a section of threads to be threaded on the threaded hole in the support posts 307, and an end section 315 of threads in a smaller diameter having a transverse through pin hole to align the longitudinal through hole in the movable jaw 306 and the screw hole in the drum-shaped nut 311 to join the annular block 311 by a pin 314;

a drum-shaped nut 311 with a screw hole in its center to receive the 315 of the guide rod and also with a transverse pin hole to receive the pin 314 therein to join the drum-shaped nut 311 and guide screw 308.

a base 312 to be locked by a screw316 on the bottom of the movable jaws 306 to avoid their slip off therefrom;

The above said clamp vise can produce clamping and fixing or stretching and pushing force by the positive and reverse rotational drive of the guide rod and also pressing of the drum-shaped nut against the movable jaws.

FIGS. 3-4 to 3-10 also show various examplary forms of the same clamp claws as shown in FIGS. 1-3 to 1-9.

Figures 1, 2, 3, 4:
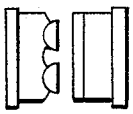

(3) FIGS. 4, 4-1, 4-2 also show the examplary forms of the invention used to the precision milling vise, which mainly compose:

a machine base 401 having a fixed jaw 402 on its one end, the fixed jaw 402 having clamp claws 403, and the middle section of said base 401 having a slide rail to allow the movable jaws 404 sliding therebetween, its other end having a support post 405 with a through hole, its two ends to be inserted into the bearing set to stop the push;

a movable jaw with a clamp claw 403 on each of its two sides respectively, a structure porvided on its bottom to make slides in coupling the guide rail of the machine base without any slip-offs therefrom, and a longitudinal through screw hole 407 to receive the screw 408;

a guide screw 408 with threads on its one end to be threaded in the threaded hole 407 in the bottom of the movable jaw, its other end to be coupled to the support post section 405 which has a transverse through hole to receive the annular block 409 on the outer side of the push-stop bearing 406 of the post 405, a positioning pin 410 (or snap ring) making the annular block 409 positioned on the guide screw 408 which in turn makes the guide screw 408 positioned and rotatable on the support post.

By the above-said structure, said milling machine clamp vise can effect the clamping, fixing and pushing stretching functions to be applied to the milling machine processing. FIGS. 4-3 to 4-9 show various examplary forms of the clamp claw shown in FIGS. 1 -3 to 1-9.

Figures 1, 2, 3, 4, 5:
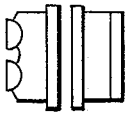

Further, the above-said examplary forms belong to the manualdriven driven guide screw way. However, in practical use, the vise can also be driven by other electric-operated or hydrodynamic powered elements. FIGS. 5 to 5—5 show the examplary forms of the vises driven by the electric motor. Enclosures 3 and 4 illustrate the examplary forms of the conventional oil hydraulic or pneumatic driven vises, as their drive structure can be used to the design of the present invention, no repetition in this respect is needed herein. The following are the examplary forms of the vise structure added with the electric motor dirve in this respects in which ;

As shown in FIG. 5 to 5-2, this design features that the drive motor is mounted on the drive base 502 of the guide screw 501, and so this is an examplary form of the guide screw that displace along with the movable jaw, in which a set of drive motor 503 having a reduction gear case, a set of mutually engaged gear set 504 and pinion set 505 and a drive base 502 having an adequate spare and a join cover 506 are included, of which;

a key slot 507 is axially cut in the rod plane of said guide screw 1 to couple and align the screw hole 508 in the drive base 502, a polygonal head 509 is formed at the end of said guide screw 1 to mesh the handle bar for manual rotary movements;

a key slot 507 is axially cut in the surface of said guide screw 1 and also couples and aligns the screw hole 508 in said drive base 502, the end of said guide screw 1 is a polygonal head 509 to mesh the handle bar for manual rotary movements;

said drive base 502 and thebase bottom 510 are integrally cast in the same body, a screw hole 508 is provided at the position where the opposite guide screw 501 passes through and is mounted, and in the inner side of said screw hole 508 has a key hole in a proper depth for radially positioning the bearing therein, a hole seat is inwardly provided on one side of the screw hole 508 on the back to receive and position the reduction gear box of the drive motor 503 therein, and the output shaft of the reduction gear box extends forward and to the place beyond the drive base 502 to drive the pinion 505 into motion;

the front end of said drive motor 503 has a reduction gear box, during assembly, the reduction gear box or even the reduction gear box including the body of the drive motor 503 maybe laid into the key hole in the drive base 502, the transverse protruding plate protruding from the reduction gear box leans against the drive base 502, and then fixing pieces each the protroding plate;

gear set and pinion set 505 are the intermediate madia to transmit the power of said drive motor 503 to said guide screw 501, of which said pinion 505 is mounted on the output shaft of the reduction gear box, while said gear 504 is sleeved on said guide screw 501 to energy said pinion 505, said gear 504 drives, with its key 511, said guide screw 501 passing there through into motion;

the join cover 506 is made, in coordination with the configuration said drive base 502, in such a manner that its middle part warps upward and its two sides extend to closely lean against said drive base 502, and the wing plates on its two sides are bolted and locked by the screw 512 on the base seat 510 as its feature, before said join cover 506 is positioned, firstly according to the installation of said gear 504 and pinion 505 since said pinion 505 is mounted on the output shaft of the reduction gear box and said gear 504 go through and is also sleeved on said guide screw 501, two radial bearings are simultaneously and succesively mounted on the two sides of said gear 504 to make various transmission elements precisely positioned, besides, further a protruding shaft 3 having a square stock is provided on the back of said drive motor for manually operating the handle bar to drive them;

said movable jaw 518 and fixed jaw 519 respectively their two-directional clamp claws 520, 521, the bottom of the movable jaw has a sunk cut slot 522 to receive a drum-shaped nut 515, said drum-sahped nut 515 has a transverse pin hole to mesh the threads 517 in the end of said guide screw 501 and then a pin 516 joins said movable jaw and guide screw 501, the bottom of said movable jaw has a screw hole which is joined, by a screw 524, to the bottom plate 523, the traction of above-said nut drives the movable jaw into motion to effect the two-directional clamping actions.

FIGS. 5-3 to 5-5 show another examplary form of the said two-directional clamping vise driven by an electric motor, in which the bottom of said movable jaw has a couping nut which will effect in conjunction with said guide screw, the rotary drive but does not displace with said movable jaw in said drawing:

one side of said base 551 is provided with a fixed jaw 552 having the two-directional clamp claws 553, 554 and a guide rail 555 to allow said movable jaw 558 with said two-directional clamp claws 556. 557 sliding thereon;

the other side of said base 551 is provided with a support post 559 and a motor base 560 to join the motor 561 having a reduction device thereon;

said support post 559 has a middle section with its two sides having a larger diameter and a through hole 562 in a smaller diameter; and the thrust-stop nearings 563, 564 are respectively inserted into its two sides;

one end of said guide screw 565 has a square stock 666 to couple the operating handle bar and a section of threads 567 which can extend to the two sides of the bearings and two pin holes to receive a positioning nut 570 having a pin hole, where a pin 568 joins them, and , the gear 571 having pin hole terrace flange in the inner side for spirally meshing thereon, and a pin 569 joins them;

another end of said guide screw has guide travel threads to couple the inner threads 572 on the bottom of the movable jaw to drive the movable jaw into motion;

the output shaft of the motor 561 joins a gear 573 which couples the above-said gear 571 having the pin hole terrace flange, and the motor drives the guide screw into motion which in turn drives the movable jaw moving to effect the normal functions.

The above-said electric-operated clamp vise is controlled by a switch to make the drive motor use the reduction gear box to drive said pinion into motion and the gear to drive the guide screw by the key, thereby achieving the rapid feed and backward movements said stop control on the feed and backward movement can further achieve the objects by the preset touch switch or the selected governable motor (if the difference between the load and the governable current is smaller, and a series excited motor with larger magnetic field windings for overheat protection), or the resettable electric power supply to drive the DC or AC motor for drive, therefore, the main components of the above-said power-driven two-directional clamp vise are described as follows:

movable jaw and fixed jaw respectively provided with the two-directional clamp claws;

a truction structure between the drive structure and the movable jaw can bear the strong two-directional strength of the clamping and pressing and stretching and pushing forces;

the drive structure includes oil hydraulic cylinder or electric or hydrodymac-driven types.

Figures 1, 2, 3, 4, 5, 6:
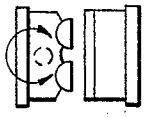
Figures 1, 2, 3, 4, 5, 6, 7:
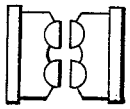
Figures 1, 2, 3, 4, 5, 6, 7, 8:
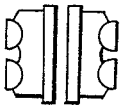
Figures 1, 2, 3, 4, 5, 6, 7, 8, 9:
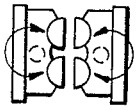
Figure 1:
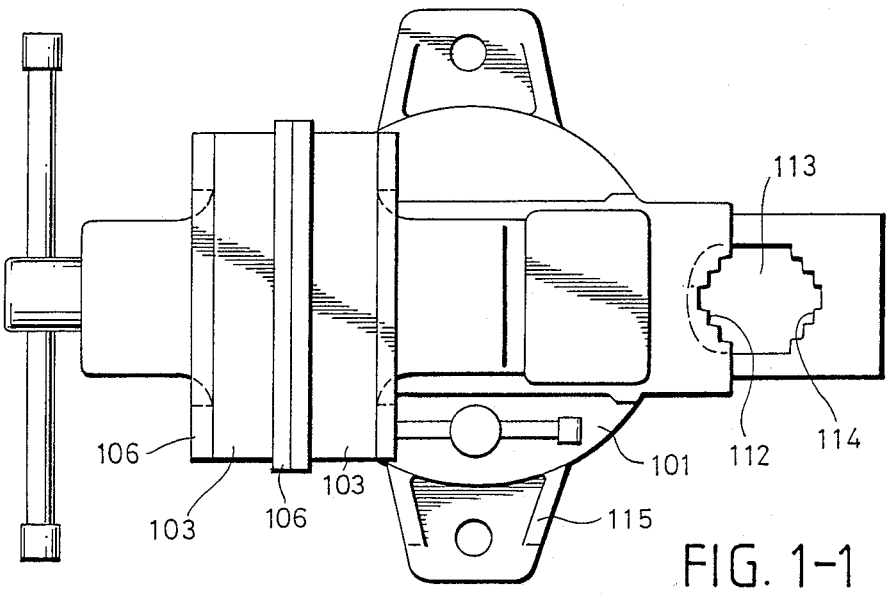
Figures 1, 2:
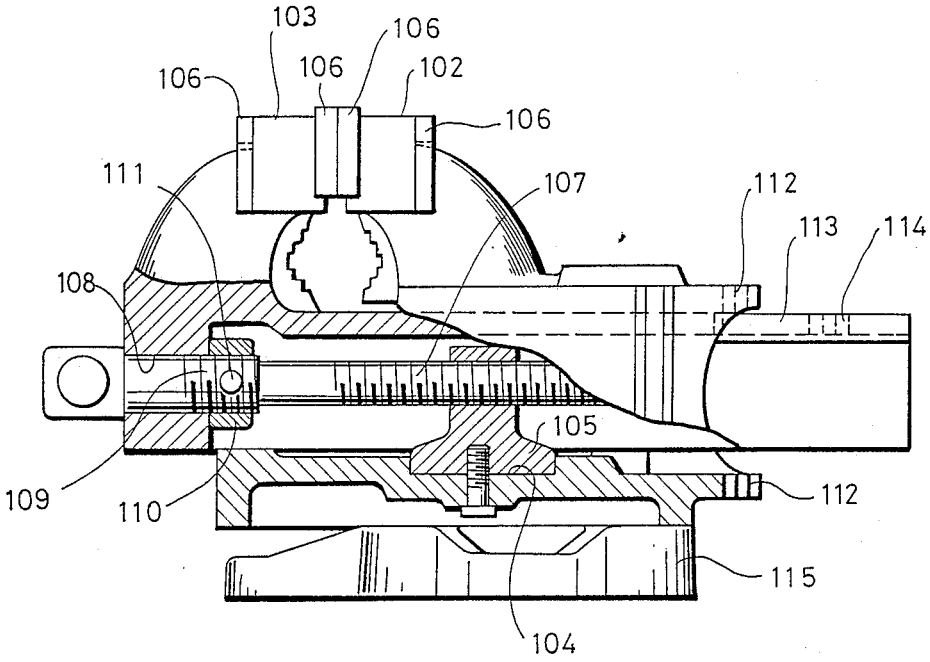
Figure 2:
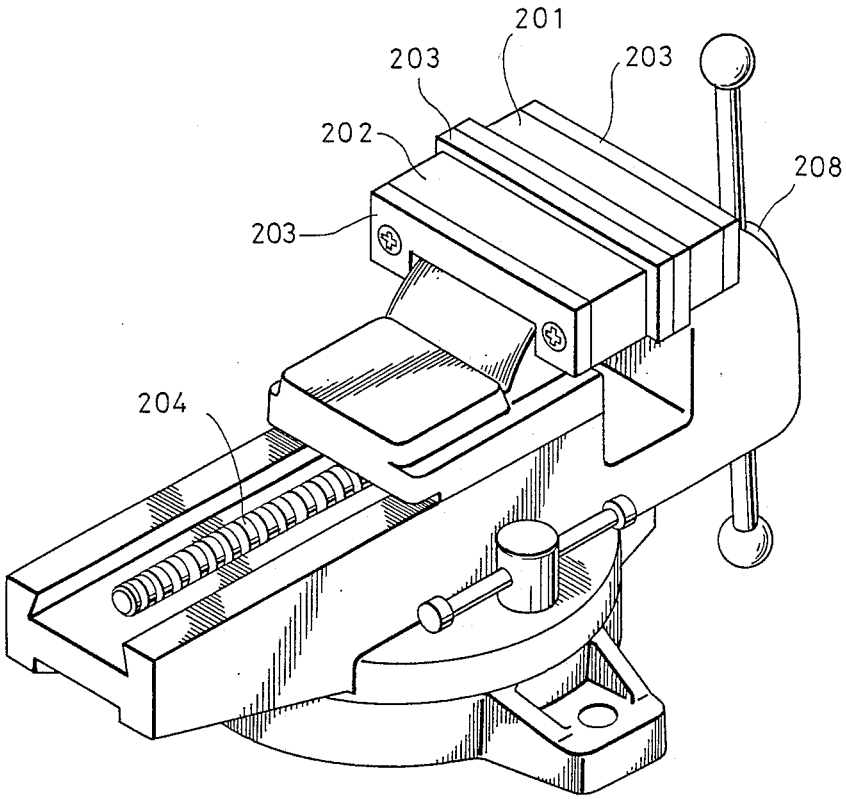
Figures 2, 3:
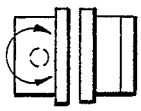
Figures 2, 3, 4:
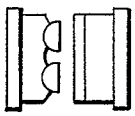
Figures 2, 3, 4, 5:
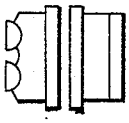
Figures 2, 3, 4, 5, 6:
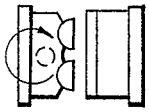
Figures 2, 3, 4, 5, 6, 7:
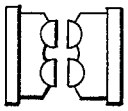
Figures 2, 3, 4, 5, 6, 7, 8:
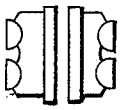
Figures 2, 3, 4, 5, 6, 7, 8, 9:
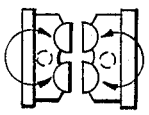
Figures 1, 2:
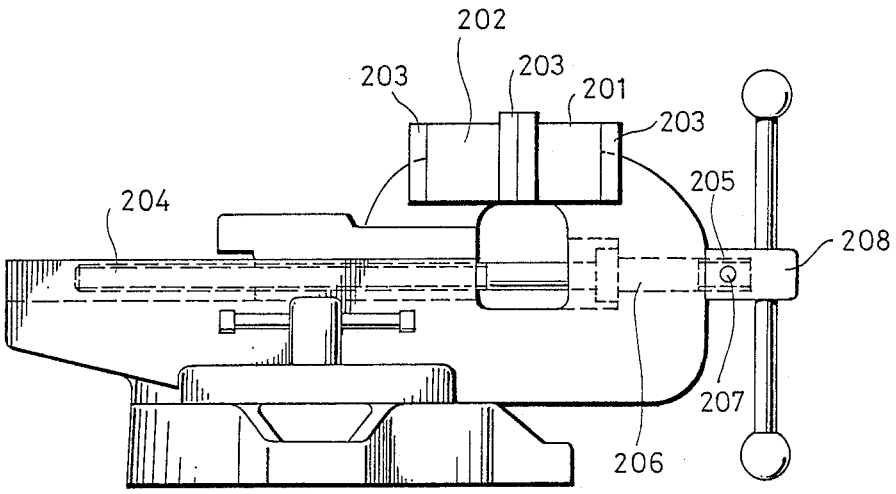
Figure 2:
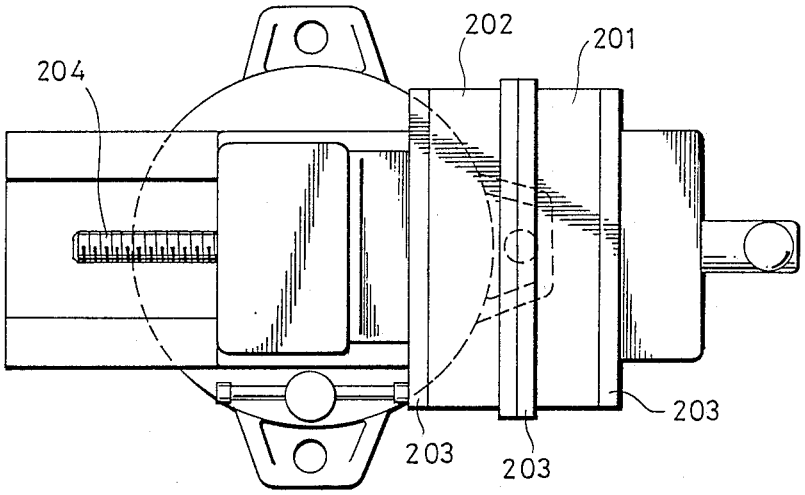
Figure 3:
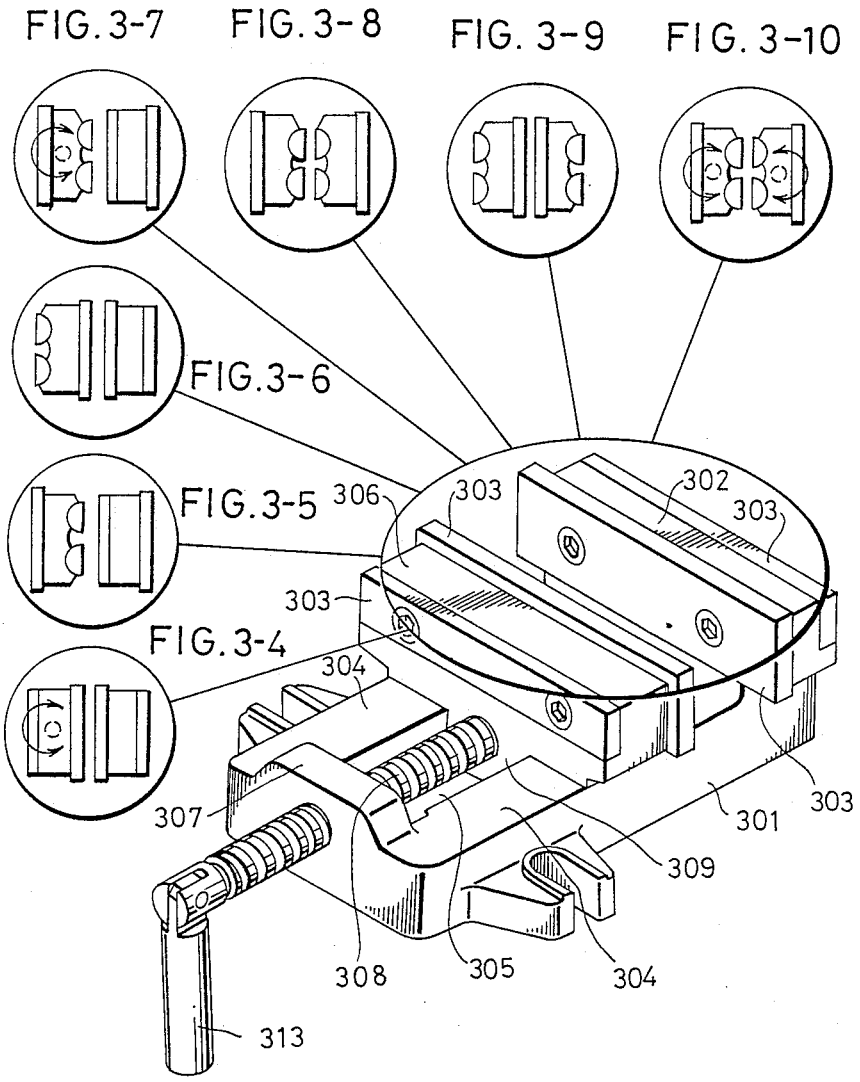
Figures 1, 3:
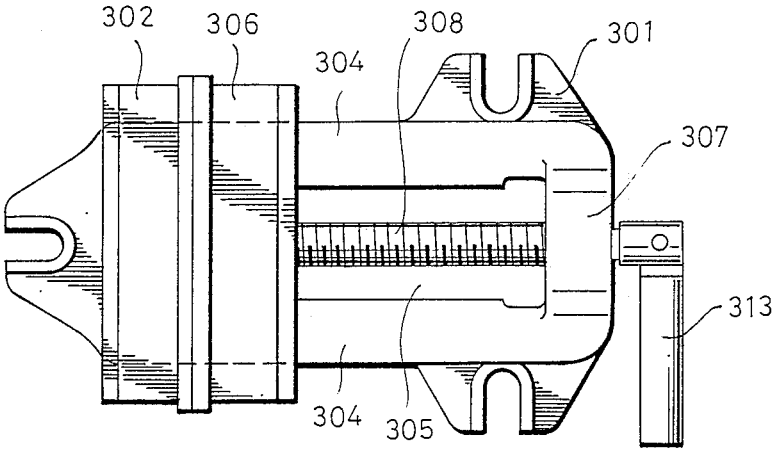
Figures 2, 3:
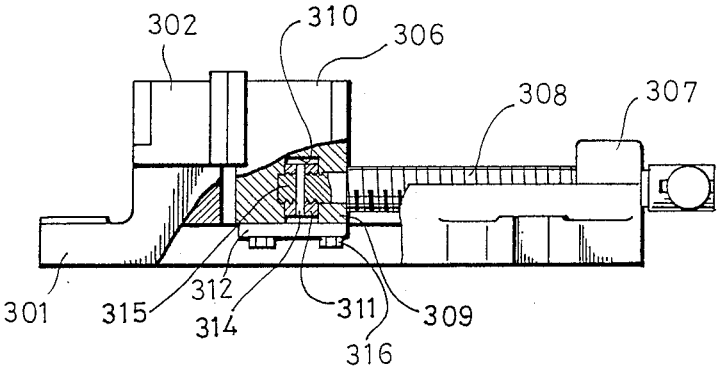
Figure 3:
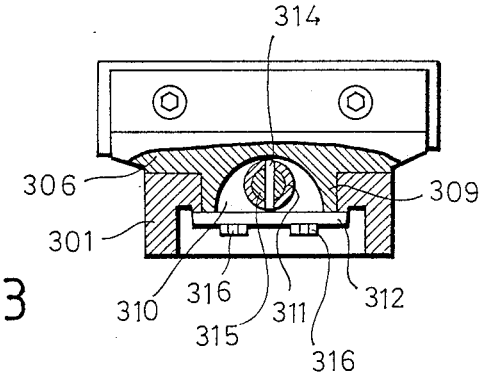
Figures 1, 4:
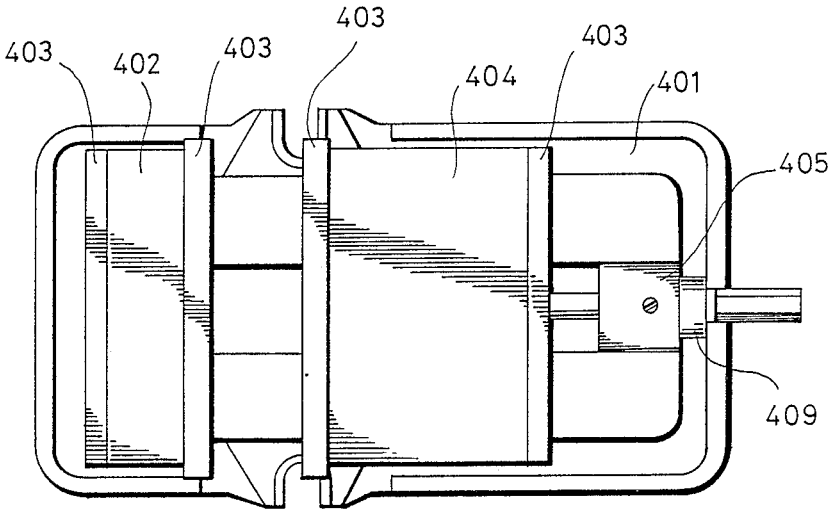
Figures 2, 4:
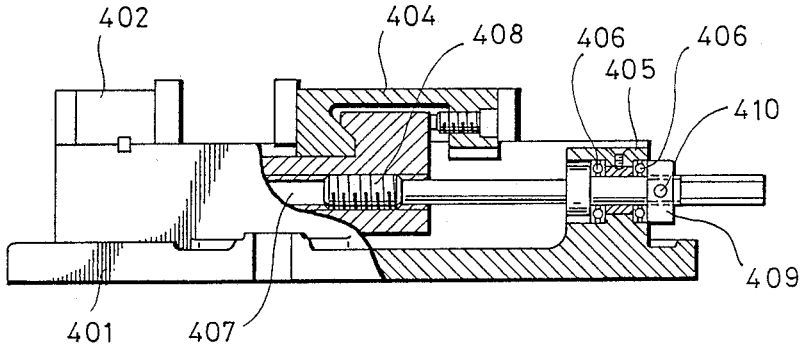
Figure 5:
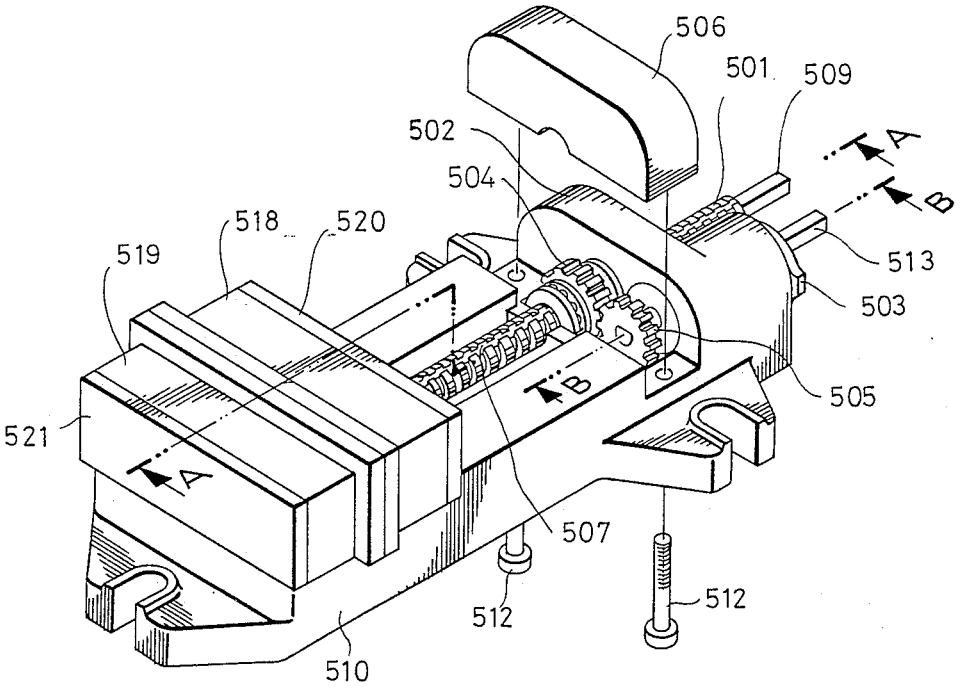
Figures 1, 5:
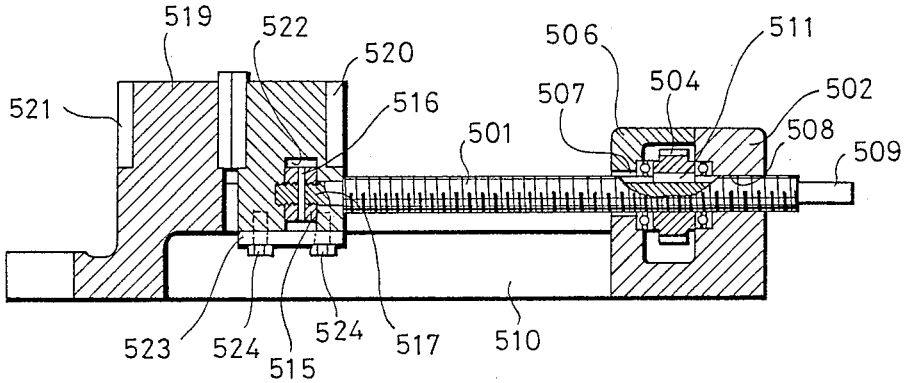
Figures 2, 5:
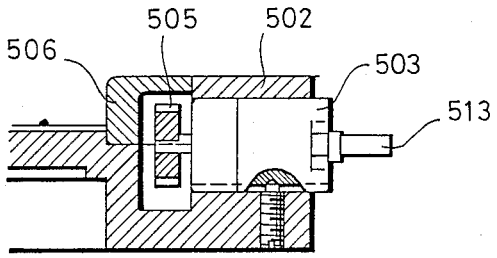
Figures 3, 5:
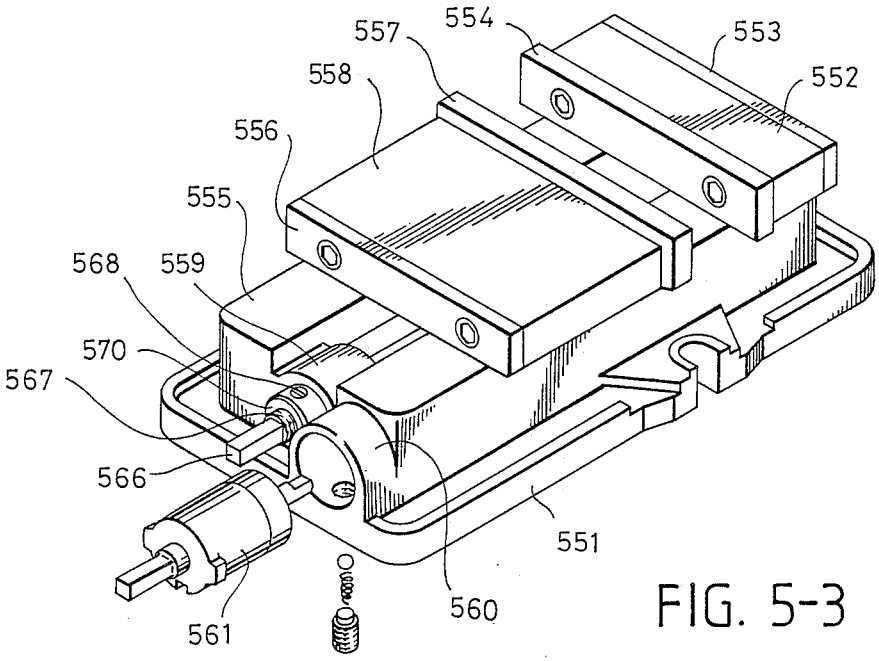
Figures 4, 5:
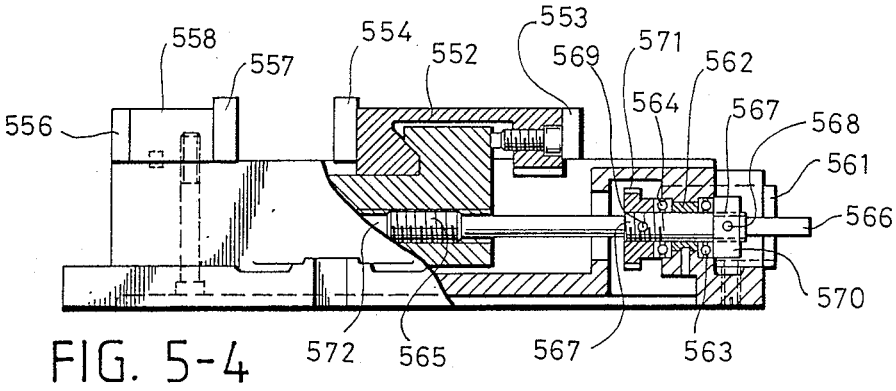
Figure 5:
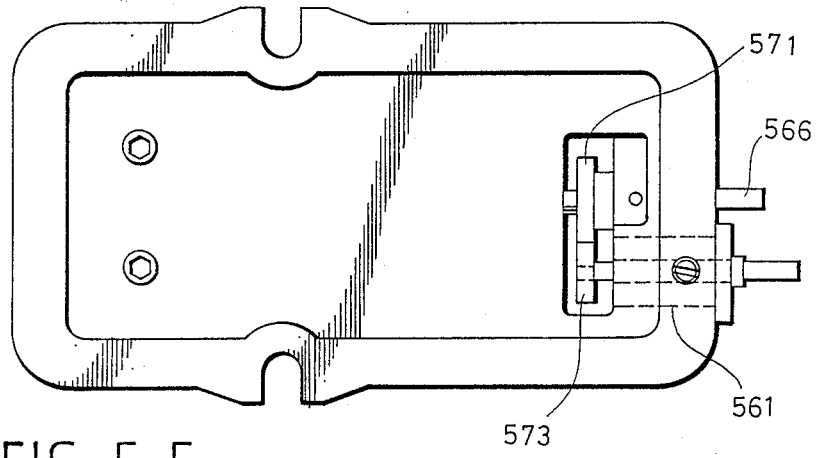
Figures 5, 6:
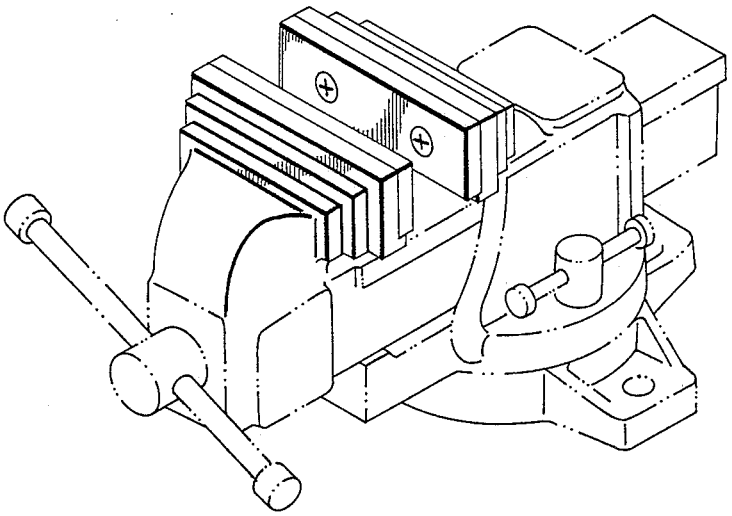
Figures 5, 6, 7:
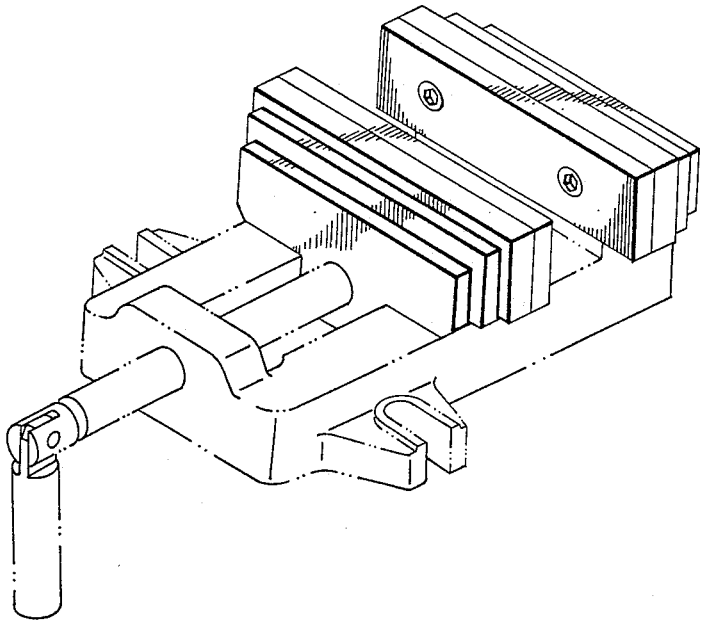

Besides, the above-said various kinds of the two-directional drive jaw can further be in the forms as shown in FIGS. 5–6, 5–7, its upper side and left and right sides respectively have the outwardly and gradually reduced terrace shape from the opposite clmaping faces to facilitate the pushes and stretches of work pieces in various sizes, additionally, the clamping or pushing or stretching faces of the clamp claws of said two-directional to clamp jaw shown in FIGS. 1 to 5–7 can be added with the softer or harder clamp plates, or one or both of these plates are directly constructed by the jaw body itself.

In summary, the vise of the present invention can apply two-directional forces on the guide rod for driving the movable jaw with respect to the fixed jaw. The drive may be by manual, electric motor, oil hydraulic or pneumatic power means. Both jaws have two-directional clamp claws to clamp the workpiece therebetween and/or to be disposed within the workpiece and thereby secure it by stretching or pushing outwardly against the workpiece. Also, the notched (tooth hole) in the body of the movable jaw and the notches (concave terrace shapes) on the upper and lower rims of the fixed jaw may clamp workpieces with perpendicular long pipes or rods. The rotation of the body permits the vise to extend out from the workbench to which it is mounted so that pipes extending to the floor may be clamped. Thus, the vise may be driven by an electric motor to maximize use of the device in mass production applications thereby effecting lower costs, reduced man hours and more effective operations.

I claim:

1. A vise, comprising a body having a lower base portion and an upper portion including a fixed jaw, the body further having a guide slot formed therein, a movable jaw slidably received in the guide slot, the movable jaw having a longitudinal opening formed therein and communicating with the base, an upstanding lug secured on the base and disposed in the longitudinal opening in the movable jaw, a rod threadably received in the lug and disposed within the longitudinal opening in the movable jaw, the movable jaw further having a hole formed therein and communicating with the longitudinal opening therein, the threaded rod having a portion projecting through the hole and forwardly of the movable jaw, such that the threaded rod is rotatably journaled in the hole in the movable jaw, a handle on the forwardly-projecting portion of the threaded rod, and a positioning nut keyed to the threaded rod, the nut being disposed within the longitudinal opening in the movable jaw and on the side of the hole opposite from the handle;

wherein the movable jaw which is slidably received in the guide slot of the body has an end extending outwardly from the guide slot of the body, the end further having an elongated notched slot therein; the upper portion of the body further having a concave notched recess therein, such that a workpiece may be disposed vertically through the slot in the end of the movable jaw and may be clamped against the cooperating notched recess in the body such that the workpiece may be secured therebetween.

2. The vise of claim 1, wherein the lower base portion of the body is secured to a work surface and the upper portion of the body is rotatably connected to the lower base portion of the body so that the upper portion may be rotated through 180°.

3. The vise of claim 1, wherein the fixed jaw has an inner side and an outer side and the movable jaw has an inner side and an outer side, further each jaw has a clamp claw on the inner side and the outer side respectively such that the clamp claws on inner sides of the respective jaws may clamp a workpiece therebetween, and the clamp claws on the outer sides of the respective jaws may be adjustably disposed within a workpiece to secure the workpiece thereabout such that the jaw may bear forces in two directions.

4. A vise, comprising a body having a lower base portion and an upper portion including a fixed jaw, the body further having a guide slot formed therein, a movable jaw slidably received in the guide slot, the movable jaw having a longitudinal opening formed therein and communicating with the base, an upstanding lug secured on the base and disposed in the longitudinal opening in the movable jaw, a rod threadably received in the lug and disposed within the longitudinal opening in the movable jaw, the movable jaw further having a hole formed therein and communicating with the longitudinal opening therein, the threaded rod having a portion projecting through the hole and forwardly of the movable jaw, such that the threaded rod is rotatably journaled in the hole in the movable jaw, a handle on the forwardly-projecting portion of the threaded rod, and a positioning nut keyed to the threaded rod, the nut being disposed within the longitudinal opening in the movable jaw and on the side of the hole opposite from the handle; the fixed jaw having an inner side and an outer side, the movable jaw having an inner side and an outer side, further each jaw having a clamp claw on the inner side and the outer side respectively such that the clamp claws on inner sides of the respective jaws may clamp a workpiece therebetween, and the clamp claws on the outer sides of the respective jaws may be adjustably disposed within a workpiece to secure the workpiece thereabout such that the jaw may bear forces in two directions; the movable jaw which is slidably received in the guide slot of the body further having an end extending outwardly from the guide slot of the body, the end further having an elongated notched slot therein; the upper portion of the body further having a concave notched recess therein, such that a workpiece may be disposed vertically through the slot in the end of the movable jaw and may be clamped against the cooperating notched recess in the body such that the workpiece may be secured therebetween; and the lower base portion of the body being secured to a work surface and the upper portion of the body being rotatably connected to the lower base portion of the body so that the upper portion may be rotated through 180°.

* * * * *